US011470901B2

(12) United States Patent
Mayer

(10) Patent No.: US 11,470,901 B2
(45) Date of Patent: Oct. 18, 2022

(54) HAIR PIECE

(71) Applicant: Laura Mayer, Topanga, CA (US)

(72) Inventor: Laura Mayer, Topanga, CA (US)

( * ) Notice: Subject to any disclaimer, the term of this patent is extended or adjusted under 35 U.S.C. 154(b) by 382 days.

(21) Appl. No.: 16/543,471

(22) Filed: Aug. 16, 2019

(65) Prior Publication Data

US 2020/0054086 A1 Feb. 20, 2020

Related U.S. Application Data

(60) Provisional application No. 62/719,823, filed on Aug. 20, 2018.

(51) Int. Cl.
*A41G 5/00* (2006.01)

(52) U.S. Cl.
CPC ..... *A41G 5/0073* (2013.01)

(58) Field of Classification Search
CPC ..... A41G 5/00; A41G 5/0006; A41G 5/0013; A41G 5/002; A41G 5/004; A41G 5/0046; A41G 5/0053; A41G 5/006; A41G 5/0073; A41G 5/0086; A41G 5/0093; A41G 3/00; A41G 3/0008; A41G 3/0016; A41G 3/0033; A41G 3/0041; A41G 3/005; A41G 3/0058; A45D 2/00; A45D 2002/005; A45D 2002/006; A45D 2002/007; A45D 2002/008; A45D 2/127; A45D 2/14; A45D 2/146; A45D 2/148; A45D 2/16; A45D 2/20; A45D 8/34; A45D 8/36; A45D 8/38; A45D 8/40
See application file for complete search history.

(56) References Cited

U.S. PATENT DOCUMENTS 5,289,834 A * 3/1994 Lawrence ..... A45D 8/34 132/212
5,417,230 A * 5/1995 Wood ..... A45D 8/00 119/600
5,806,538 A * 9/1998 Keltner ..... A45D 8/34 132/200
6,035,864 A * 3/2000 Kennedy ..... A45D 8/34 132/273
6,041,792 A * 3/2000 Kennedy ..... A45D 8/34 132/275
2005/0072440 A1* 4/2005 Lee ..... A41G 5/004 132/53
2005/0268930 A1* 12/2005 Lane ..... A41G 5/0073 132/128

(Continued)

*Primary Examiner* — Rachel R Steitz
*Assistant Examiner* — Karim Asqiriba

(57) ABSTRACT

A hair piece of artificial, animal or natural hair or a combination thereof wherein the hair piece is configured to be used as a removable hair piece such as a ponytail or hair extension. The hair piece may include an attachment member for attachment to the ponytail of a user. The hair piece may further include a bendable spine member to allow the user to adjust the configuration of the hair piece. The hair piece may further include an elongate flexible member having a greater rigidity than the hair wherein the elongate member is interwoven in the strands of the hair to allow the user to adjust the configuration of the hair piece. The hair piece may also include a variety of hair styles, textures or textiles to provide a versatile hair style that is easily installed or removed by the user.

11 Claims, 11 Drawing Sheets

(56) References Cited

U.S. PATENT DOCUMENTS

| | | | | |
|---|---|---|---|---|
| 2006/0174908 | A1* | 8/2006 | Srivastava | A45D 8/12 132/275 |
| 2006/0225758 | A1* | 10/2006 | Kuglen | A45D 8/36 132/128 |
| 2010/0229882 | A1* | 9/2010 | Sotokawa | A41G 3/0083 132/54 |
| 2010/0326455 | A1* | 12/2010 | Karsenti | A41G 3/0008 132/53 |
| 2014/0238430 | A1* | 8/2014 | Adams | A41G 5/0053 132/201 |
| 2016/0066671 | A1* | 3/2016 | Astwood | A41G 5/006 132/273 |
| 2018/0035738 | A1* | 2/2018 | Hayes | A41G 5/0046 |

* cited by examiner

HAIR PIECE

BACKGROUND

The present invention relates to natural, synthetic or artificial hair that is preferably similar to the properties of natural hair and may be used in a variety of arrangements such as ponytails, hair extensions or hair weaves. The hair is arranged in a variety of configurations such as braids, goddess locks, straight hair or wavy hair. For the purposes of the present application, the term hair or artificial hair is intended to include in its meaning any hair, natural, simulated, various textiles, textures or synthetic or combination thereof which is not intact and growing on the particular user's head and may also include animal hair or feathers as part or all of a hair piece.

Generally, natural hair has a diameter of about 80 to 100 mm. Natural hair also has unique characteristics that cause the hair to act differently in dryness or humidity such that the flexural rigidity of natural hair will change. Accordingly, as used in a wig, weaves or hair extensions, it is preferred to use artificial hair that has as many characteristics of natural hair as possible. In recent years, due to constraints on the supply of natural hair, significantly more synthetic hair material has been manufactured. Synthetic material is often manufactured using synthetic polyacrylic, polyester-based or polyamide-based materials.

Polyacrylics that are utilized for artificial hair fiber have a low melting point and poor heat resistance, and thus form a poor perm. Volume is applied to the fibers during processing but exposure to environmental factors such as hot water or humidity cause the bonds to be broken. In addition, the feeling or tactile feel of polyacrylic hair is different than with natural hair.

Another approach is the use of polyester fibers. The polyester fibers have greater strength and are an excellent heat resistant material. A downside is that the polyester fibers have a very low hygroscopicity as compared with natural hair, so e.g. natural hair exhibits a different look, feel and physical properties in a high-humidity environment. This produces discomfort when used as a wig of hair or in certain weaves where natural hair and polyester fibers are combined or are adjacent to each other. When natural hair is exposed to rain or moisture, the volume of the hair elongates and spread occurs. However, the moisturizing and hygroscopic characteristics of polyester fiber is extremely small, thus volume retention and elongation rarely occur. Therefore, the use of artificial hair made of polyester fiber, does not show the same level of volume or tactile feel of natural hair with moisture. Further, if the polyester hair is made to the same diameter as natural hair, the bending rigidity is too high. Bending rigidity refers to the tactile sensation and fiber, texture and other values associated with a bending force required to bend the hair. The bending rigidity is also called bending stiffness. The unit size of the bending moment is the inverse of the resulting change in curvature defined by applying force on the artificial hair. The larger the bending rigidity of artificial hair, the smaller the bending flexibility and the harder it is to bend the artificial hair. In contrast, the smaller the bending rigidity, the greater the bending flexibility and the artificial hair feels relatively flexible and soft to the user.

When the artificial hair is made of a single polyester fiber with a natural hair diameter of about 80~100 Mm, it has a very high bending rigidity compared with natural hair. When the polyester fiber is attached to a wig base, the rigidity causes it to extend upwardly too much and is uncomfortable for the user. When the polyester fiber is formed as part of a hair extension or weave, the user feels the differing characteristics of natural hair and the polyester fibers. Further, the feel of the polyester-based hair compared to natural hair is that of a stiff texture with a high hardness. Additionally, there is a tendency for the polyester fibers to separate from the natural hair with an increase in the moisture of the hair.

Another approach is to use a polyamide fiber to form the artificial hair. The polyamide fiber may also use a surface treatment to reduce the unnatural gloss of polyamide fibers. A polyamide fiber, such as an aliphatic polyamide is preferred in workability however, the bending rigidity is low, so even when planted on the wig base, the fiber poorly erected, lying along the wig base. Therefore, the use of aliphatic polyamide produces an artificial hair that is stiff with a lack of a sense of fullness. Yet another approach is to use a double sheath core structure made by an aliphatic polyamide resin and aromatic polyamide resin using dual polyamides. These combinations overcome some of the deficiencies described above. Other approaches include the mixing of artificial hair and natural hair.

As described above, the goal is to make use of an artificial hair weave, weft or ponytail as close to natural hair in appearance, tactile and texture. Further, it is necessary that the hygroscopicity and tensile strength, elastic modulus, or physical properties such as bending rigidity are of values that are not significantly inferior to that of natural hair.

Artificial hair integrations such as hair extensions or hair weaves or wefts, add length and/or fullness to human hair. Hair extensions are usually clipped, glued or sewn on to other hair by incorporating additional human or synthetic hair. Natural human hair can be penned, dyed and flat ironed, whereas synthetic hair cannot. The attachment methods include tape in extensions, clip in or clip on extensions, fusion methods, weaving or wigs. Examples of various weft approaches are described in the following references. U.S. Pat. No. 5,921,253 granted to Jeong, Ho-Taeg on Jul. 13, 1999; U.S. Pat. No. 6,135,122 granted to Campbell on Oct. 24, 2000 and U.S. Pat. No. 6,405,736 granted to Townsent on Jun. 18, 2002.

U.S. Pat. No. 7,458,383 granted to Song discloses a further weft for hair extensions. In the Song patent, a method of attaching a weft to human hair is disclosed wherein the weft includes a plurality of crimpable pressure rings. The human hair is threaded through the rings and then the rings are crimped to retain the weft and artificial hair in position on the head of the user. U.S. Pat. No. 9,486,024 granted to Kim et. al discloses a further method of attaching a weft to the hair of the user. In this patent, integrally looped hair sections are looped around a flexible track such that the sections of artificial hair may be adjusted in length and are movable along the tract when the track is attached to the head of the user. In the method of using the weft, a base anchor is attached to the user's head and the track is sewn onto the base anchor. The hair of the user is positionable between the sections of the artificial hair.

U.S. Pat. No. 3,955,587 granted to Dunn et. al. discloses a wig for use on dolls or humans wherein coated metal wire is dispersed throughout hair filaments to create a changeable shape coiffure. U.S. Pat. No. 5,899,211 granted to Brown discloses an artificial hair piece includes an independent extension of synthetic human hair secured at one end to a stretchable, twistable, and foldable elastic loop or band. The opposite end of the extension can either be free or can be gathered and tied or otherwise bound. The elastic loop can be used to secure gathered actual hair of a user into, for example, a ponytail. The hair extension can then be wrapped around the elastic loop to hide it from view and give the impression that the hair extension is securing the ponytail in place. The hair extension can be selected to match one or more characteristics of the user's own hair.

U.S. Pat. No. 9,486,024 granted to Kim et. al. discloses a hair extension for attachment to a person's head using a plurality of hair sections that are held together by a flexible track. The hair sections overlap on the track and a movable upwardly or downwardly relative to the person's natural hair.

Hair extensions can provide instant length, fullness, and enhance the appearance of a user. Many types of hair extensions are available for different methods of attachment. For example, small sections of hair may be attached to a user one by one via braiding, tying, bonding, clamping, shrink tubing, weaving, gluing, etc. Such attachment methods are also referred to as strand-by-strand attachment and provide relatively light weight hair extensions that can move with user's natural hair when styling. However, a strand-by-strand attachment method is time intensive and relatively expensive.

A weft hair extension is a more cost effective and less time intensive option. A weft hair extension typically includes a weft extending along the top, on which an elongate swathe of hair is attached. The weft hair extension may be attached to a user using micro rings, clamping, braiding, tying, bonding, tape, glue or by sewing to user's hair. For example, a section of user's hair may be held together close to user's scalp by a double-sided tape, and a weft hair extension may be attached to one side of the tape. Subsequently, the weft hair extension and the attached hair are pulled upwards and another weft extension may be attached on the other side of the tape. A weft hair extension may also be sewn to user's hair. In this method user's hair may be braided, for example into corn-rows, to which a weft hair extension may be sewn in.

Weft hair extensions can be attached faster than hair extensions attached by the strand by strand method, and they are less costly. However, since hair strands are fixed on a weft, movement of the hair extension is limited, and styling of hair is more difficult. Further, due to the relatively bulky nature of the weft, the hair extension is more visible than those attached via strand-by-strand method, especially when hair is pulled up in an up-style, such as a ponytail. Accordingly, it is desirable to provide a hair extension that can be attached relatively quickly and look natural in various hair styles A further popular hair style is to use artificial hair for ponytails. With ponytails, the user's natural hair is used to blend in and cover the attachment for the artificial hair. The ponytail is a popular method to provide a quick way to give the user the appearance of longer hair that may be arranged in a variety of configurations such as waves, braids or goddess locks. Various conventional attachment methods are used including adhesives, clips, wraps and loops.

SUMMARY

The present invention is an apparatus and method for creating and securing synthetic or artificial hair to create a natural looking ponytail or extension. The method comprises creating and securing a ponytail or similar hair configuration of the user with artificial hair, other than the user's own intact hair. The artificial hair is then connected and wrapped about the area of creation and securement of the ponytail. The natural hair of the user is then used to cover the area of creation and securement of the ponytail. This area is also called the base of the ponytail.

The apparatus comprises a length of hair, other than the user's intact hair, having a plurality of individual hair strands. First ends of the strands are connected to a hair piece or ponytail securing member, one example being a loop of elastic material. The opposite or distal ends of the strands can be free or can include a second securing member; one example being a conventional hair pin or clamp. The hair is arranged in a variety of configurations such as braids, twists, goddess locks, straight hair, curly hair or wavy hair. For the purposes of the present application, the term hair is intended to include in its meaning any hair, natural, animal, simulated, synthetic or a combination thereof which is not intact and growing on the particular user's head. As used herein, feathers or other decorative accessories may also be included as a part of the hair piece, twists or braids. The hair may be made of natural hair, animal hair, textiles, tinsels, plastics, fabrics, wires or similar materials or combinations thereof. Additionally, the hair and/or spine (as described below) may also include leather, plastic tubing, faux leather, flexible wires and various other textiles that may be included in or on the hair and/or spine of the hair pieces described below. Furthermore, the hair pieces of the present invention may take the form of a variety of shapes or configuration and are not limited to ponytails as described below. Similarly, a variety of decorative pieces may be added to the hair and/or spine, including illuminating elements such as glow bracelets, feathers, necklaces or beads without departing from the scope of the present invention as described in the attached claims. The loops described herein may also be in a variety of sizes, widths and configurations including for head caps or bands. The wires described herein may be in a variety of sizes or materials and may be used in a variety of configurations including wigs, ponytails or similar hair arrangements. Finally, although the present invention is described for use on humans, it is not limited to age, gender, ethnicity, adults or children and may be used on any non-human such as any animal, including horses, dogs or cats as well as dolls and toys, statuary, robots or mannequins.

The method and apparatus allow the user to both create and secure the hair piece such as a ponytail and cover the area of securement with a simulation of the user's own intact hair and conceal the true method of creating and securing the hair piece or ponytail.

DETAILED DESCRIPTION OF THE PREFERRED EMBODIMENTS

Figure 1:
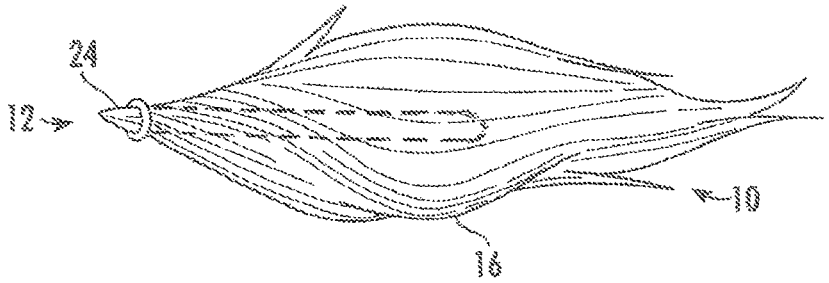
FIG. 1 is a perspective view of a preferred embodiment of the invention.
Figure 2:
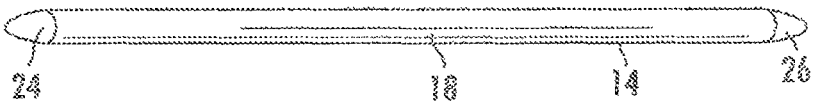
FIG. 2 is a perspective view of the spine member of the preferred embodiment of the present invention.
Figure 3:
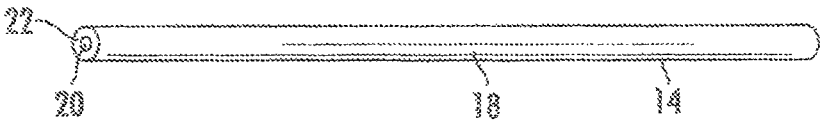
FIG. 3 is a perspective view of the cylindrical member of the preferred embodiment of the present invention.

To provide a better understanding of the invention, which is defined solely by the claims appended hereto, exemplary embodiments of the invention will now be described in detail. Frequent reference will be taken to the drawings. Reference numerals are used in the drawings to indicate certain parts or locations.

FIG. 1 generally illustrates a ponytail device 10, according to the present invention. In this embodiment, the ponytail device 10 includes an attachment member 12 for attachment of the device to the head of the user. In this embodiment, the attachment member 12 is formed to include a flexible tip member. The attachment member 12 is preferably formed of a rubber or other similar soft plastic material. In use, the attachment member is secured into position on the user's head. The use of the attachment member 12 feels more comfortable to the user than conventional metal clips or similar devices. The ponytail device 10 of this embodiment further includes a flexible spine or wire member 14 that extends along the length of the ponytail hair. In one embodiment, the spine extends one fourth of the length of the ponytail 16. In another embodiment, the spine 14 extends approximately one-half of the length of the ponytail har. In another embodiment, the spine extends greater that three fourths of the length of the ponytail and/or hair piece. The length of the spine 14 allows the user to modify, twist or otherwise arrange the ponytail hair 16 into the desired hair style.

A length of artificial hair or someone else's separated natural hair, or a combination of natural and artificial hair is made up of a plurality of individual hair strands. For the present purposes, the term hair or artificial hair is intended to include in its meaning any hair, natural, simulated or synthetic or combination thereof which is not intact and growing on the particular user's head. As described herein, the ponytail hair 16 is attached at one end to the spine 14 and is preferably loose or free at the other end thereof.

As shown in FIGS. 2-5, the spine 14 of the present embodiment is formed of multiple components that are combined to create the ponytail device of the present embodiment. As shown, the spine includes an elongate and generally cylindrical member 18. In the preferred form of this embodiment, the cylindrical member 18 consists of an inner, elongate and flexible wire 20 that is preferably surrounded or encased in a flexible material 22 such as a plastic, leather or rubber material. The cylindrical member 18 of the preferred embodiment includes material of differing flexibility and tensile strength such that the flexibility of all or part of the spine 14 may be modified for the intended use of the ponytail device 10. The cylindrical member 18 is preferably bendable into nearly any desired configuration and will retain the desired configuration until it is moved or bent into another desired configuration. The flexible material 22 is chosen to retain its flexibility over multiples bends and may also preferably colored or dyed to generally match or contrast with the desired hair color of the ponytail 16 or hair piece. Similarly, the wire and casing as described below may also be colored or dyed to generally match or contrast with the desired hair color of the ponytail 16 or hair piece. The flexible material is further chosen to provide frictional resistance to limit the lateral movement of the ponytail hair 16 along the spine 14. The wire 20 is preferably formed of a highly flexible metal with a high tensile strength such as a surgical wire. The wire 20 and/or flexible material 22 may or may not have a matching color casing to match the hair and retains the flexibility over multiple bends. Alternately, the spine 14 may be solely constructed of a metal such as a surgical wire or electrical wire having the desired bending characteristics. The spine 14 further includes a first end tip 24 and a second end tip 26 which are affixed to the ends of the cylindrical member 18. The first end tip 24 functions as the attachment member 12 as described above. The first end tip 24 and the second end tip 26 are preferably formed of a flexible and soft material such as a rubber material or felt to provide a soft end surface that is positioned against the skin of the user when the ponytail device 10 is positioned on the head of the user. In one form of the present invention, one end of the spine 14 may be bent into a generally circular portion to function as an attachment member such that the bent portion of the spine may be wrapped around a bun or ponytail of the user.

Figure 4:
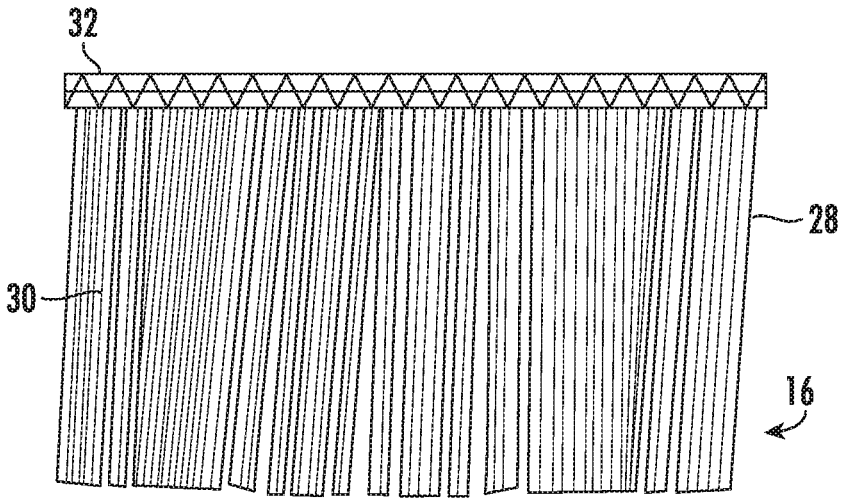
FIG. 4 is a perspective view of the weft of artificial hair of the preferred embodiment of the present invention.

FIG. 4 illustrates the weft 28 or elongate string of hair strands 30 that are used to form the ponytail device 10 of the present embodiment. As shown, the end of hair strands 30 as sewn into the elongate weft 28. In this embodiment, one or more layers of thread 32 or similar materials are used to sew or otherwise attach the ends of the hair into the elongate weft to retain the fixed end of the hair 16. As shown, the hair 16 may be of generally fixed length or may be varied depending on the style of ponytail desired.

Figure 5:
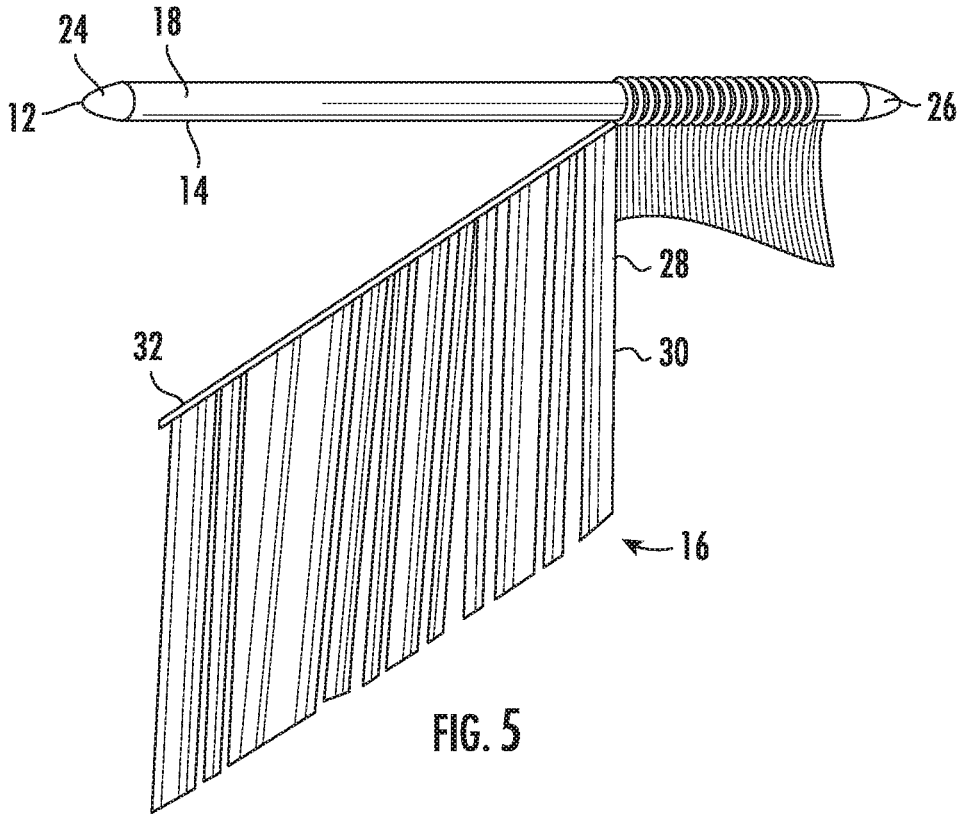
FIG. 5 is a perspective view of the assembly of the preferred embodiment of the present invention.

FIG. 5 is illustrative of the method of forming the ponytail device 10 of the present invention. As shown, the weft 28 is wrapped around the cylindrical member 18. The preferred pattern is similar to that of fly tying for fishing wherein the weft 28 is wrapped and moved lengthwise along the cylindrical member 18 while the free end of the hair 16 is allowed to extend outwardly from the cylindrical member 18. In one form of this embodiment, one or more ties or strings may be tied along periodic lengths of the spine 14 to minimize the lateral or lengthwise movement of the weft along the spine as the ponytail device is formed. As the end of the spine 14 is reached by the weft, the weft 28 may be cut and sewn onto the spine. Alternately, the end of the weft 28 may be fixed in position by the attachment of the first end tip 24 and/or the second end tip 26 onto the ends of the cylindrical member 18. The first end tip 24 and/or the second end tip 26 may be glued or frictionally fit onto the ends of the cylindrical member 18. Alternately, the ends of the weft 28 may be sewn into place using thread of the same general color as the hair of the weft 28. As shown, the free ends of the hair may extend a substantial length beyond the spine to form a naturally looking and flexible ponytail. Similarly, the cylindrical member 18 of the spine 14 may be bent into a variety of configurations to create a ponytail that may assume nearly any configuration desired by the user. In an example of this embodiment, the spine is of any length or dimension although in one example, the spine may be approximately 20 inches long while the ponytail hair is approximately 18 inches long. In an example of this embodiment, the wefts are of any length or dimension although in one example, the length of the weft is approximately 98 inches long to provide a thick ponytail. In the preferred form of this embodiment, the entire hair piece from the attachment member 12 to the free end of the hair may be of any length although in this embodiment, the length is approximately 30 inches. In another form of the present invention, the length of the spine 14 may be greater than at least one-half as long as the length of the hair to provide an elongate spine 14 that allows the ponytail to be configured into multiple arrangements. The dimensions set forth herein are for exemplary purposes and may be varied according to the hair style or arrangement desired by the user. For the sake of clarity, the hair extending from the weft 28 near the second end member 26 of the cylindrical member 18 is not shown in FIG. 5 to allow for the illustration of the hair strands 30 extending from the thread 32 of the weft 28. It is to be understood that the weft 28 may include hair strands 30 extending along all or part of its length to form the desired hair piece.

Figure 6:
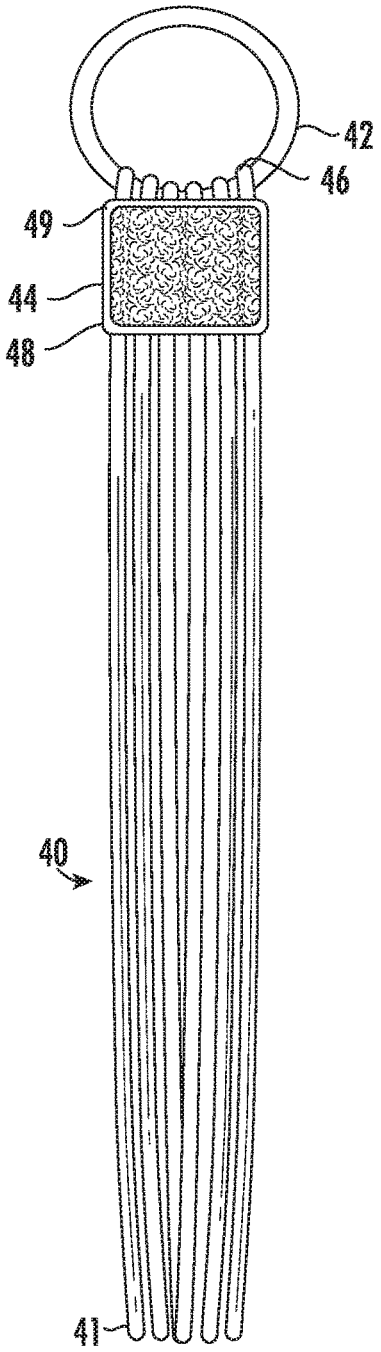
FIG. 6 is a perspective view of an alternate embodiment of the present invention showing the front view of a mesh member for a hair configuration having goddess locks.
Figure 7:
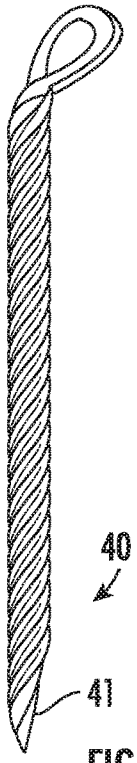
FIG. 7 is a perspective view of an alternate embodiment of the present invention showing a hair configuration having goddess locks showing a single goddess lock of hair.
Figure 8:
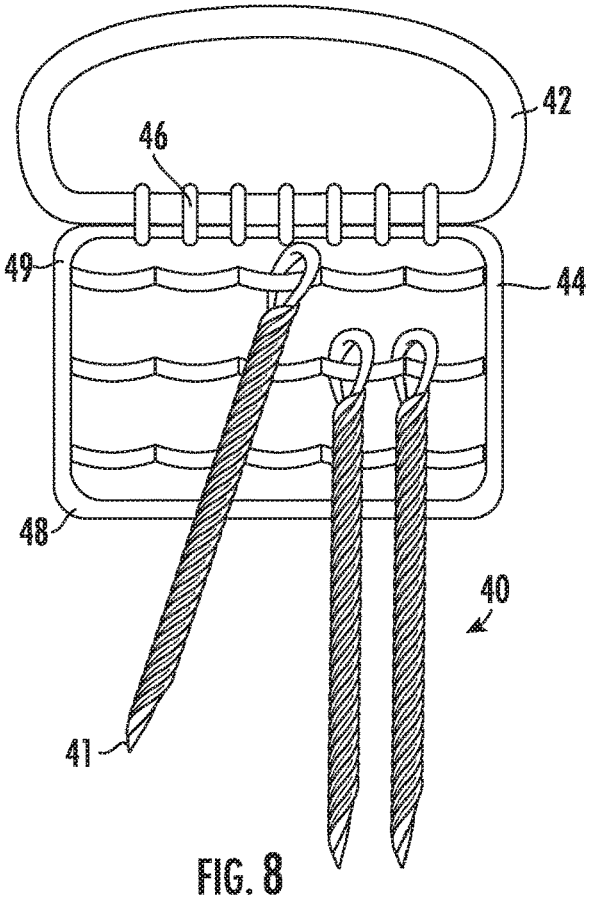
FIG. 8 is a perspective view of the alternate embodiment of FIG. 6 of the present invention showing the back surface of the mesh member for a hair configuration having goddess locks showing the attachment of the goddess locks on the mesh member.

FIGS. 6-8 are illustrative of a further embodiment of the present invention wherein the ponytail 40 is configured as goddess locks. As shown in this embodiment, a flexible loop 42, is provided for creating ponytails. The loop 42 is essentially a continuous strand, ring, or band of elastic, such as rubber, enclosed or covered by an elastic fabric and formed into a continuous loop. In an example of this embodiment, the loop may be of any length, width or dimension although in this example, the loop 42 can be on the order of three inches in diameter in a normal non-extended state. Any part of it or its whole is expandable to several times its normal length while at the same time being foldable and twistable. One end of the ponytail 40 of this embodiment may be fixed to a decorative mesh 44 and the decorative mesh is attached to the loop 42 by a plurality of spaced apart tabs 46. In this embodiment, the mesh 44 extends outwardly from the circumference of the loop 42 such that a first end portion 48 of the mesh 44 extends further away from the loop than the second end portion 49 of the mesh so that the ponytail 40 desirably lays generally flat along the hair of the user than with a single loop or equal distance mesh.

The mesh 44 of the present embodiment preferably also includes a binding area on the outer periphery that is thicker than the more centrally located mesh area. The central area of the mesh may be formed of a flexible material such as a wig lace. Additionally, with the goddess lock configuration of the present embodiment, a plurality of ribbon type members extend along the mesh 44 perpendicular to the first end portion 48 and the second end portion 49 and the ends of the goddess locks are attached thereto. The ribbons provide a reinforcing function as well as provide a small amount of lateral movement to allow the goddess locks to move naturally on the head of the user. In the preferred form of the present invention, approximately five bands of ribbon are used although nearly any number of ribbons may be used to accomplish the desired hair style or appearance. The ribbon is attached at multiple locations to the wig lace of the mesh 44. As shown in FIG. 7, the ends of the hair are secured to the mesh 44 by weaving the hair strands thereto or otherwise securing the hair along multiple locations along the lengthwise dimension of the mesh 44. In the embodiment shown, the top row of ribbon includes about seven loops for attachment of the goddess locks thereto. The number of goddess locks attached to the ribbons decrease along the lengthwise dimension of the mesh such that 7 loops are used, then 5 loops are used, the 4 loops are used, then two rows of 3 loops are used. The tabs 46 are then wrapped around the loop 42 and each end of the tabs are then tied to the mesh 44 by thread or other materials. Other ways or configurations of the loops and rows are possible depending on the final desired hair style. The hair strands are twisted and woven into goddess locks at the tail end 41 of the ponytail 40. In an example of this embodiment, the goddess locks are of any length or dimension although in one the present example, the goddess locks may be approximately 36 inches long and the mesh may be approximately 3 inches by 3 inches as an exemplary dimension.

The loop 42 functions to secure a user's ponytail, in the same way an elastic or rubber band would conventionally do so, but then includes a length of hair which extends from the mesh 44 and can then be wrapped around the mesh 44 to both conceal the loop 42 and mesh 44 and appear as if the user's own intact hair created and secured the user's ponytail in place. Alternately, because a decorative mesh 44 is used all or a portion of the mesh 44 may be exposed to appear as if the user has a hair clip or decorative design on the ponytail.

Figure 9:
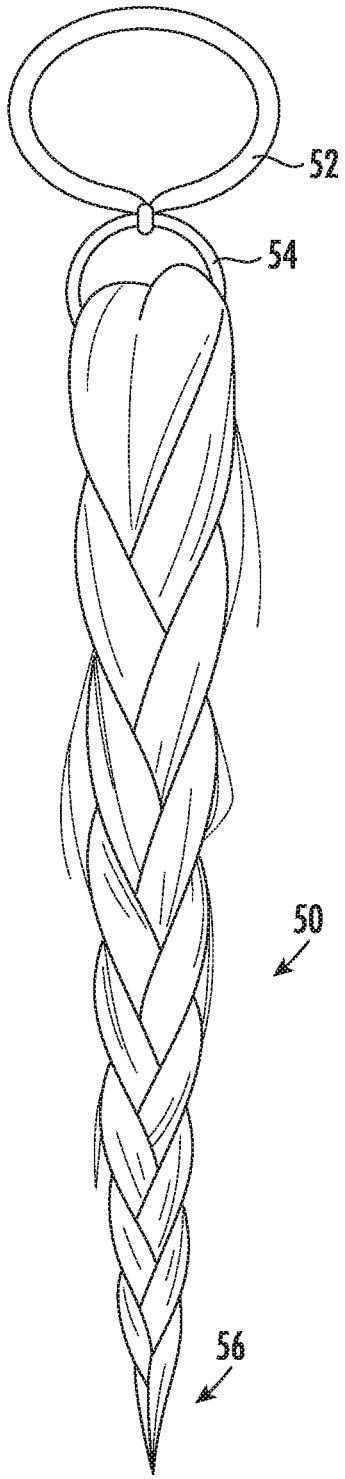
FIG. 9 is a perspective view of an alternate embodiment of the present invention showing a hair configuration having single braid ponytail.
Figure 10:
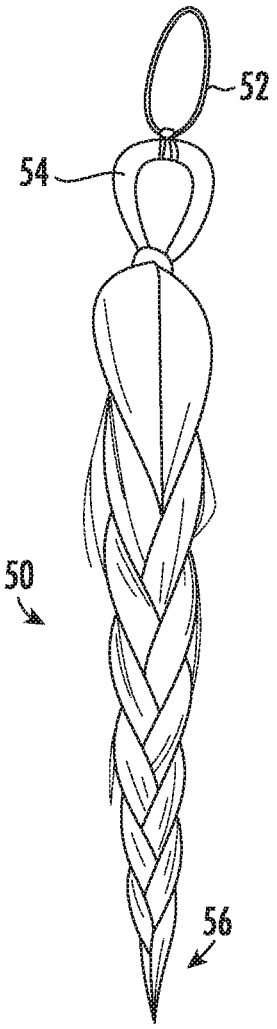
FIG. 10 is an enlarged perspective view of the single braid ponytail of FIG. 9.

FIGS. 9-10 are illustrative of a further embodiment of the present invention wherein the ponytail 50 is configured as an elongate single braid ponytail. As shown in this embodiment, a flexible loop 52, is provided for attaching the ponytail. The loop 52 is essentially a continuous strand, ring, or band of elastic, such as rubber, enclosed or covered by an elastic fabric formed into a continuous loop. The loop 52 can be of nearly any dimension and in an exemplary configuration, the loop 52 may be on the order of three inches in diameter in a normal non-extended state. Any part of it or its whole is expandable to several times its normal length while at the same time being foldable and twistable. One end of the ponytail 50 of this embodiment is braided into a loop of hair 54 and the loop 52 is threaded through the loop of hair 54. In this embodiment, the opening of the loop 52 is preferably aligned parallel to the loop of hair 54 to allow the ponytail 50 to lay flat once it is placed on the head of the user. The hair strands are twisted and braided into a long single braid at the other end 56 of the ponytail 50. In an example of this embodiment, the hair is any length or dimension although in the present example, the hair may be approximately 62 inches to form an elongate single braid of approximately 31 inches.

The loop 52 of this embodiment functions to secure a user's ponytail, in the same way an elastic or rubber band would conventionally do so. The user may then include a length of their own hair which can then be wrapped around the loop 52 to both conceal the loop 52 and appear as if the user's own intact hair created and secured the user's ponytail in place. The tail end 56 of the ponytail 50 of this embodiment may include a rubber band, band or decorative clip or even a small amount of tape or adhesive to ensure that the braid does not come undone during use.

Figure 11:
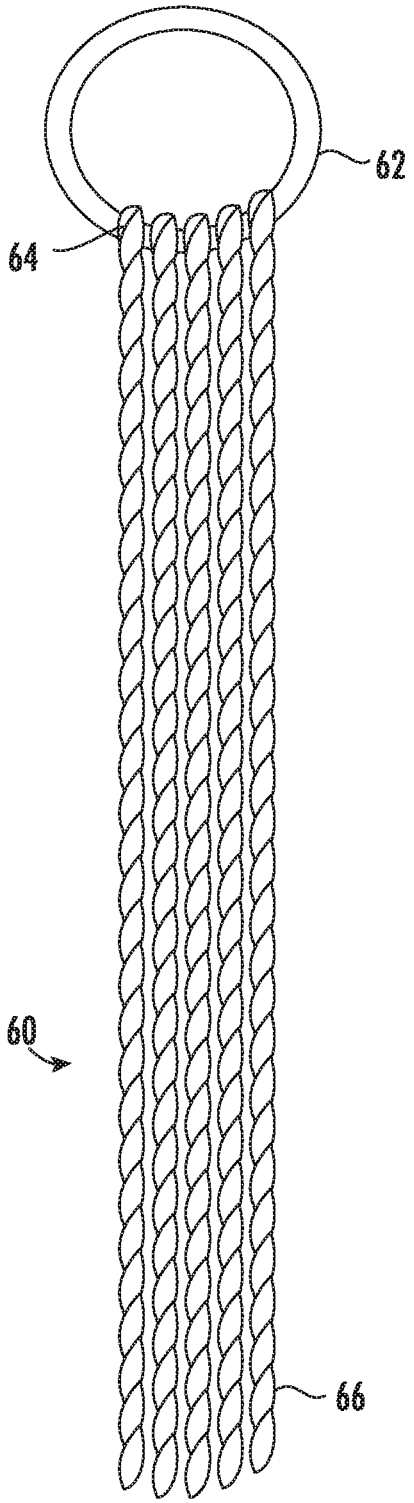
FIG. 11 is an alternate embodiment of the present invention showing a hair configuration having a thin multi-twist ponytail.
Figure 12:
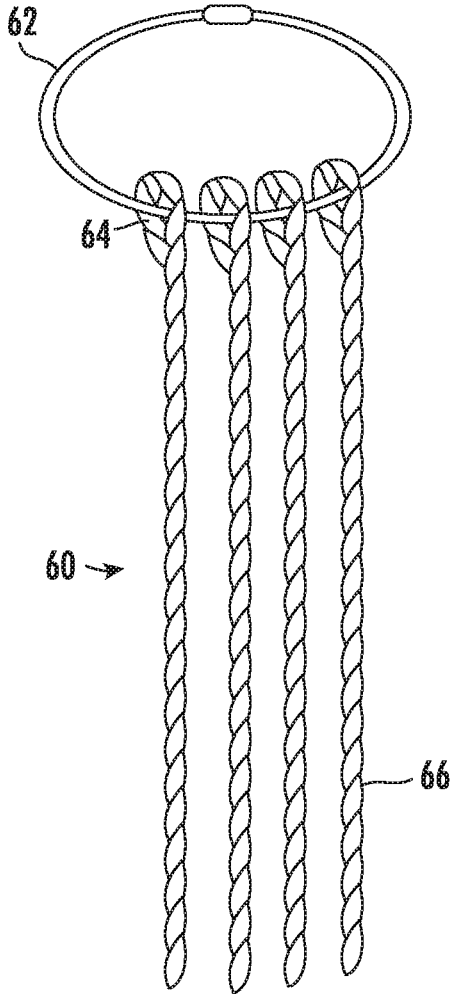
FIG. 12 is a perspective view of the multi-twist ponytail of FIG. 11 showing enlarged hair loops.

FIGS. 11-12 are illustrative of a further embodiment of the present invention wherein the ponytail 60 is configured as an elongate thin braided ponytail having multiple braided strands. As shown in this embodiment, a flexible loop 62, is provided for creating the ponytail or hair extensions. The loop 62 is essentially a continuous strand, ring, or band of elastic, such as rubber, enclosed or covered by an elastic fabric formed into a continuous loop. The loop 62 can be on the order of about two inches in diameter in a normal non-extended state, although the loop can be any length or dimension. Any part of it or its whole is expandable to several times its normal length while at the same time being foldable and twistable. One end of the ponytail 60 of this embodiment is braided into a loop of hair 64 and the loop 62 is threaded through the loop of hair 64. In this embodiment, the opening of the loop 62 is aligned perpendicular to the loop of hair 64 to allow the ponytail 60 to lie generally flat from the head of the user. The hair strands are twisted into multiple long twists at the tail end 66 of the ponytail 60. In an example of this embodiment, the strands are of any length or dimension although in one example, the strands are approximately 32 inches long and may be configured as medium or small twists. In the medium twist configuration, approximately 10 strands are used. In the small twist embodiment, approximately 60 strands are used. These quantities and dimensions are exemplary and are not intended to be limiting but are illustrative of one example of the present invention.

The loop 62 of this embodiment functions to secure a user's ponytail, in the same way an elastic or rubber band would conventionally do so. The user may then include a length of their own hair which can then be wrapped around the loop 62 to both conceal the loop 62 and appear as if the user's own intact hair created and secured the user's ponytail in place. The tail end 66 of the ponytail 60 of this embodiment is tapered and twisted or may include a rubber band, band, small amount of tape, thread or adhesive to ensure that the braid does not come undone during use.

Figure 13:
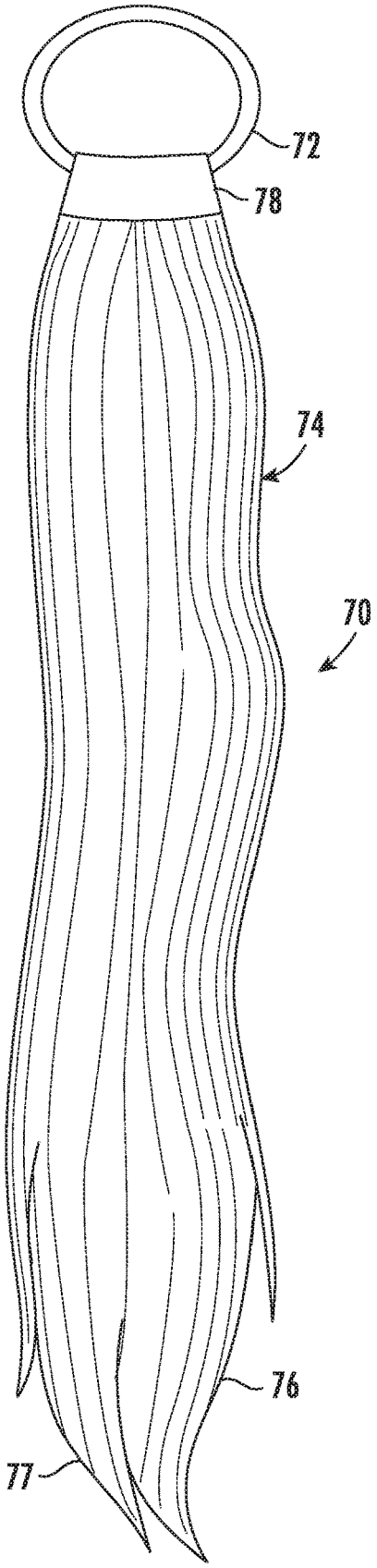
FIG. 13 is a perspective view of an alternate embodiment of the present invention showing a hair configuration having an elongate straight ponytail.
Figure 14:
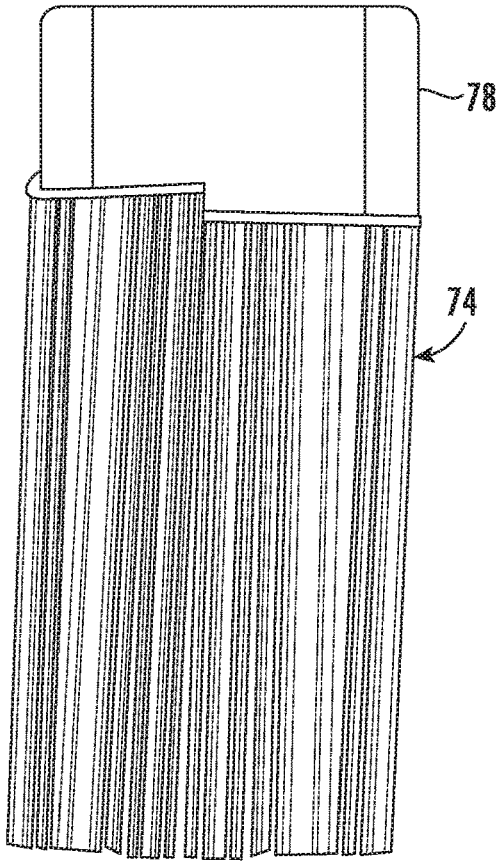
FIG. 14 is an enlarged perspective view of the assembly of the elongate straight ponytail of FIG. 13.

FIGS. 13 and 14 are illustrative of a further embodiment of the present invention wherein the ponytail 70 is configured as an elongate straight ponytail. As shown in this embodiment, a flexible loop 72, is provided for creating the ponytail. The loop 72 is essentially a continuous strand, ring, or band of elastic, such as rubber, enclosed or covered by an elastic fabric formed into a continuous loop. In an example of this embodiment, the loop is of any length or dimension although in one example the loop 72 can be on the order of about three inches in diameter in a normal non-extended state. Any part of it or its whole is expandable to several times its normal length while at the same time being foldable and twistable. One end of the ponytail 70 of this embodiment includes a weft of hair 74 that is sewn onto a piece of wig netting fabric 78 preferably having bias tape along the ends. In this embodiment, the weft 74 is folded multiple times on the netting 78 to provide a thicker grouping of hair 76 for the weft 74. The hair 76 is sewn directly onto the fabric netting 78 and the netting is sewn directly onto or is configured to cover at least portion of the loop 72. In this embodiment, the opening of the loop 72 is aligned parallel to the one end of the weft 74 to allow the ponytail 70 to lay flat in alignment with the loop 72 once it is placed on the head of the user. The hair strands from the weft 74 extend loosely to the tail end 77 of the ponytail 70.

The loop 72 of this embodiment functions to secure a user's ponytail, in the same way an elastic or rubber band would conventionally do so. The user may then include a length of their own hair which can then be wrapped around the loop 72 to both conceal the loop 72 and appear as if the user's own intact hair created and secured the user's ponytail in place.

Figure 15:
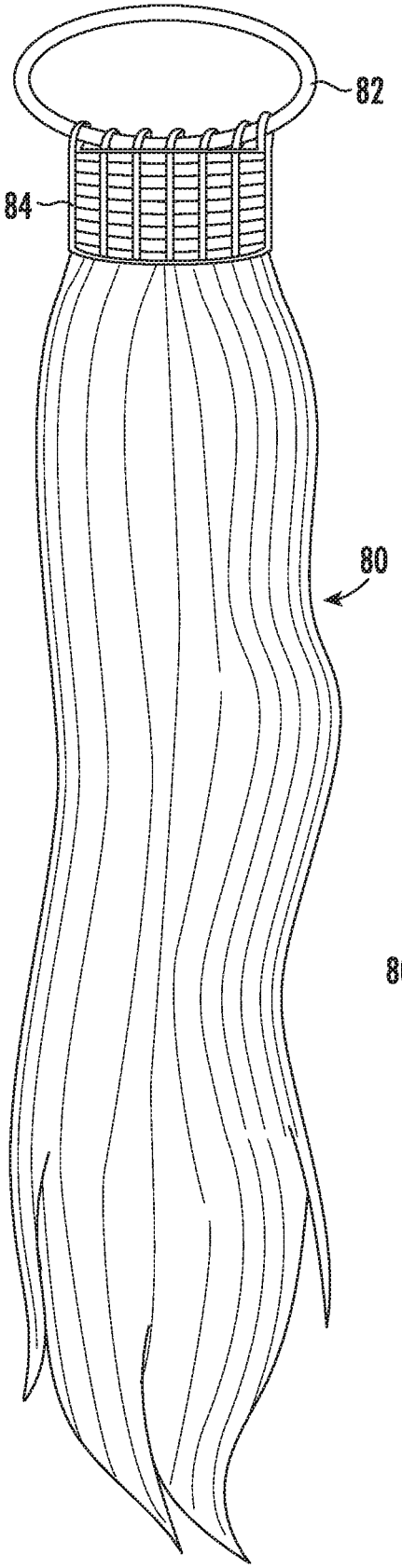
FIG. 15 is a perspective view of an alternate embodiment of the present invention showing a hair configuration having elongate wavy hair.
Figure 16:
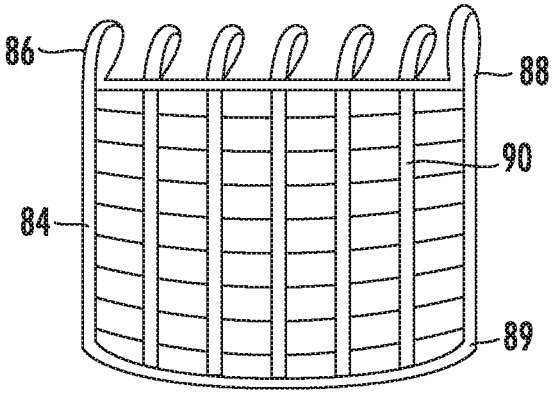
FIG. 16 is a perspective view of the mesh member for the elongate wavy hair.
Figure 17:
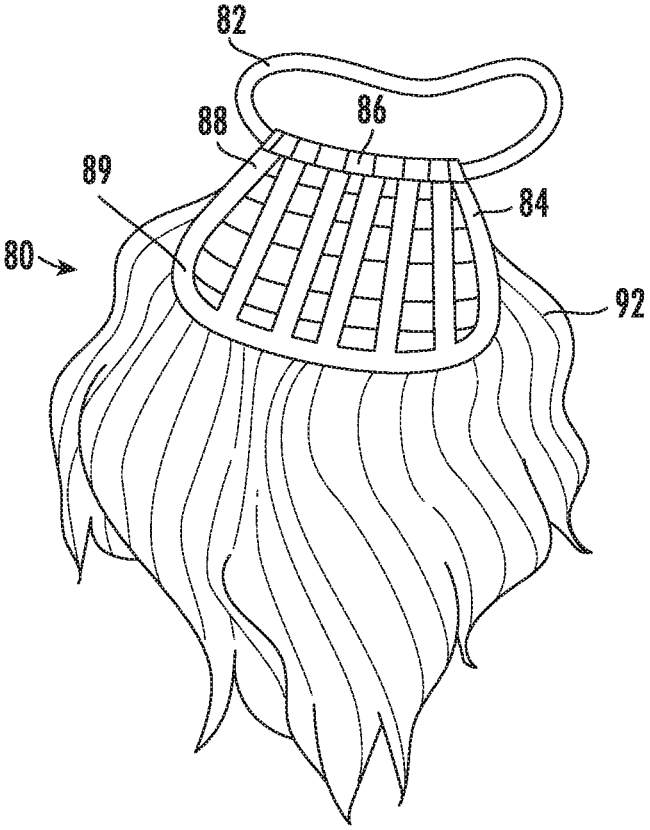
FIG. 17 is a further perspective view of the mesh member for the elongate wavy hair.

FIGS. 15-17 are illustrative of a further embodiment of the present invention wherein the ponytail 80 is configured as a length of wavy hair. As shown in this embodiment, a flexible loop 82, is provided for attaching the wavy hair to the head of the user. The loop 82 is essentially a continuous strand, ring, or band of elastic, such as rubber, enclosed or covered by an elastic fabric formed into a continuous loop. In an example of this embodiment, the loop is of any length or dimension although in the present example, the loop 82 can be on the order of about three inches in diameter in a normal non-extended state. Any part of it or its whole is expandable to several times its normal length while at the same time being foldable and twistable. One end of the ponytail 80 of this embodiment is fixed to a decorative mesh 84 and the decorative mesh is attached to the loop 82 by a plurality of spaced apart tabs 86. The first end 88 of the mesh 84 is sewn generally flush with the loop 82 and is attached to the loop 82 with the spaced apart tabs 86.

In this embodiment, the mesh 84 extends outwardly from the circumference of the loop 82 and first end of the mesh 88 such that a second end portion 89 of the mesh 84 extends laterally outwardly from the width dimension of the loop 82 and is preferably larger than the loop 82 to provide a broader surface from which the hair extends downwardly and outwardly. In this embodiment, the tabs 86 attached to the first end 88 of the mesh 84 are compressed on the loop 82 such that the width of the mesh adjacent to the first end 88 is smaller than the wider second end 89 of the mesh which extends away from the loop 82. The mesh 84 of this embodiment is configured and arranged such that the ponytail 80 lays flatter and extends further outwardly along the hair of the user than with a single loop or equal distance mesh. In a preferred form of the present embodiment, the elastic fabric 90 extends from the first end 88 to the second end 89 of the mesh and are arranged to spread out along the length dimension of the mesh 84 such that the ends of the tabs 86 that are adjacent to the first end 88 of the mesh 84 are closer to each other than the ends of the tabs 86 that are adjacent to the second end 89 of the mesh 84. The outer periphery of the mesh 84 further preferably includes an outer peripheral binding type of material to provide further support for the mesh 84. In a preferred form of this embodiment, the hair is configured as a plurality of hair wefts 92. The ends of the hair wefts 92 are secured to the mesh 84 by weaving the hair weft strands thereto along the lengthwise dimension of the mesh 84 to provide a thicker appearance than if a single layer of hair is attached at a single location along the mesh 84. In this embodiment, approximately 10 rows of hair wefts are attached to the mesh 84. The number and arrangement of the wefts may be varied depending on the desired hair style or appearance. The tabs 86 are then wrapped around the loop 82 and each end of the tabs are then tied to the mesh 84 by thread. The tabs 86 are loosely engaged with the loop 82 to allow for the lateral movement of the tabs 86 along the loop 82. The hair strands are aligned to extend downwardly from the mesh 84 to allow the user to arrange the hair as an extension with wavy hair or as a ponytail.

The loop 82 functions to secure a user's ponytail, in the same way an elastic or rubber band would conventionally do so, but then includes a length of artificial hair which extends from the mesh 84 and can then be wrapped around the mesh 84 to both conceal the loop 82 and mesh 84 and appear as if the user's own intact hair created and secured the user's ponytail in place. Alternately, because a decorative mesh 84 is used, all or a portion of the mesh may be exposed to appear as if the user has a hair clip or decoration on their ponytail.

As shown in FIGS. 18-30, like numbers are applied to like elements as described above. Modifications of the elements are described herein to further illustrate the alternate embodiment described herein. For example, the spine 14 of the alternate embodiment is formed of multiple components that are combined to create the ponytail device of the alternate embodiment. As shown, the spine includes an elongate and generally cylindrical member 18. In the preferred form of this embodiment, the cylindrical member 18 consists of an inner, elongate and flexible wire 20 that is preferably surrounded or encased in a flexible material 22 such as a plastic or rubber material. The cylindrical member 18 of the preferred embodiment includes material of differing flexibility and tensile strength such that the flexibility of the spine 14 may be modified for the intended use of the ponytail device 16 or hair piece. The cylindrical member 18 is preferably bendable into nearly any desired configuration and will retain the desired configuration until it is moved or bent into another desired configuration. The flexible material 22 is chosen to retain its flexibility over multiples bends and is also colored or dyed to generally match or contrast with the desired hair color of the ponytail hair 16. Similarly, the wire and casing may also be colored or dyed to generally match or contrast with the desired hair color of the ponytail 16 or hair piece. The flexible material is further chosen to provide frictional resistance to limit the lateral movement of the ponytail hair 16 along the spine 14. The wire 20 is preferably formed of a highly flexible material such as a metal with a high tensile strength such as a surgical wire. Alternately, the spine 14 may be solely constructed of a flexible material such as a metal which may be a surgical wire or electrical wire having the desired bending characteristics. The spine 14 further includes a first end tip 24 and a second end tip 26 which are affixed to the ends of the cylindrical member 18. The first end tip 24 functions as the attachment member 12 as described above. The first end tip 24 and the second end tip 26 are preferably formed of a flexible and soft material such as a rubber material or felt to provide a soft end surface that is positioned against the skin of the user when the ponytail device 10 is positioned on the head of the user.

Figure 18:
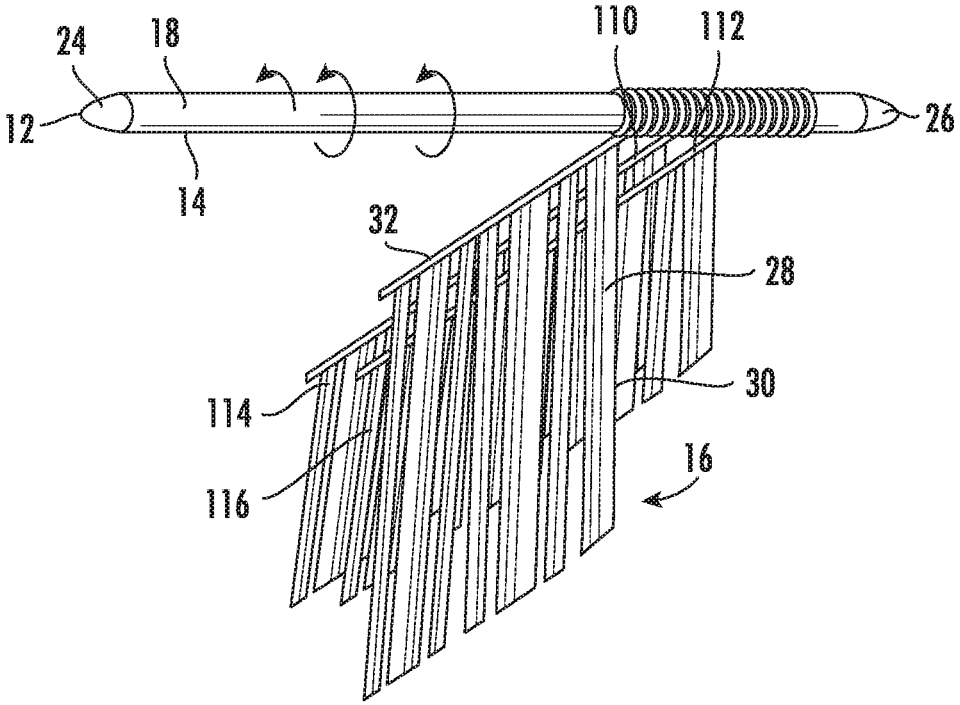
FIG. 18 is a perspective view of the assembly of an alternate embodiment of the present invention.

FIG. 18 illustrates the alternate embodiment having a plurality of wefts simultaneously wrapped along the spine 14. A plurality of wefts 28, 114 and 116 or elongate string of hair strands 30 are used to form the ponytail device or hair style of the present embodiment. Additionally, the wefts 28, 114 and 116 of this embodiment may include one or more stiffening members such as wires 120, flexible members or plastic members threaded throughout or in selected portions of the wefts 28, 114 and 116 to allow the hair strands to be further bent or arranged into the desired hair style. Although the embodiments of FIGS. 18-28 illustrate the use of three wefts, it is anticipated that fewer or more distinct wefts may be used to create the desired hair piece. Additionally, As shown, the end of hair strands 30 are sewn or otherwise attached to the elongate wefts 28, 114 and 116 and the plurality of wefts 28, 114 and 116 are wrapped around the spine 14. In this embodiment, the three wefts 28, 114 and 116 are shown as having one or more layers of thread 32, 110 and 112 or similar materials that are wrapped around the spine to retain the fixed end of the hair 16 along the spine in an overlapping or adjacent arrangement. The wefts 28, 114 and 116 may be formed of the same hair style or differing hair styles to form the desired ponytail or hair style. Although the threads 32, 110 and 112 are described herein as being formed of a flexible threaded material, it is anticipated that they may also be formed of flexible metals, wires, plastics or other durable and flexible materials. As shown, the hair 16 may also be of generally fixed length or may be varied depending on the style of ponytail or hair style desired as described below. For the sake of clarity, the hair extending from the wefts 28, 114 and 116 near the second end member 26 of the cylindrical member 18 are not shown in FIG. 18 to allow for the illustration of the hair strands 30 extending from the threads 32, 110 and 112 of the wefts 28, 114 and 116. It is to be understood that each of the wefts 28, 114 and 116 may include hair strands 30 extending along all or part of its length to provide the desired hair piece and each weft 28, 114 and 116 may include the same or different hair of varying lengths, textures and textiles to create a variety of braid and curly hair styles. Similarly, each weft 28, 114 and 116 may include a variety of wires or materials to provide rigidity or bendability for all or a part of each weft 28, 114 and 116.

Figure 19:
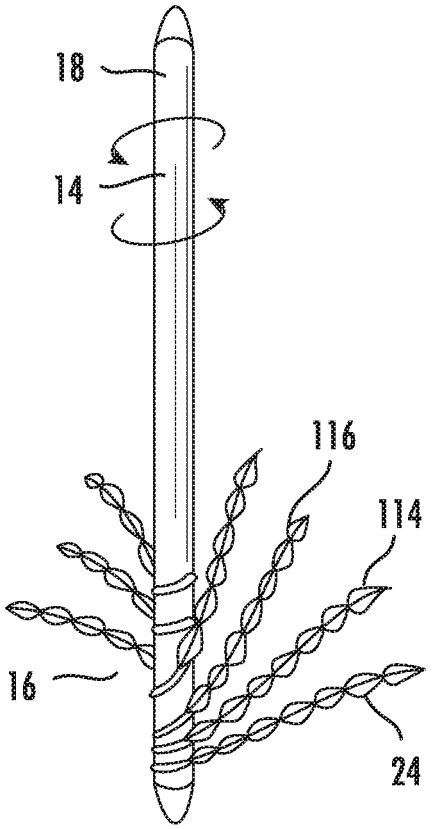
FIG. 19 is a perspective view of the assembly of an alternate embodiment of the present invention.
Figure 20:
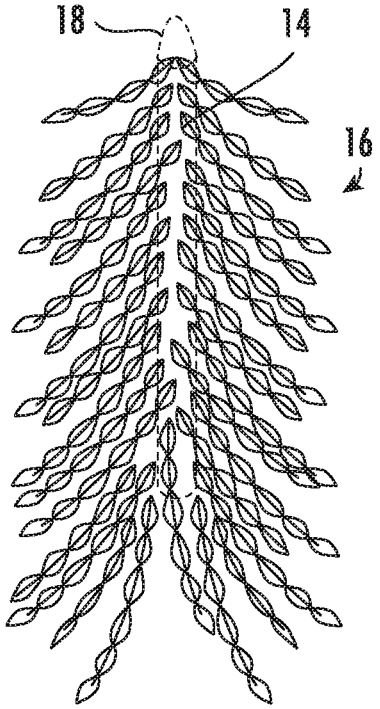
FIG. 20 is a perspective view of an alternate embodiment of the present invention showing a preferred hair configuration.

As shown in FIGS. 19 and 20, the hair strands 30 of each weft 28, 114 and 116 may be formed as small braids to provide a hair piece having multiple small braids. The hair strands 30 of this embodiment may be used in a long and down arrangement or may be wrapped around a top knot for height, volume and texture in the desired hair style. In an example of this embodiment, the strands are of any length or dimension although in one example, the strands are approximately 32 inches long and may be configured as medium or small twists. In the medium twist configuration, approximately 10 strands are used although any number of strands are used depending on the desired style or appearance. In the small twist embodiment, approximately 60 strands are used although any number may be used for the desired style or appearance. The tail end of the ponytail of this embodiment is tapered and twisted or may include a rubber band, band, a small amount of tape, thread or adhesive to ensure that the braid does not come undone during use. In this embodiment, each strand of the braid may also include a wire or similar flexible and bendable material to allow the user to adjust each braid into the desired configuration or hair style. Additionally, the use of multiple wefts 28, 114 and 116 allows the user to include braids, twists, goddess locks, straight hair, curly hair or wavy hair of differing lengths, colors, textures, accents or styles in a single hair style configuration. For example, if weft 28 includes a braided hair style of a first length, weft 114 may be formed of a braided hair style of a differing length. Weft 116 may be formed of a braided hair style of yet another length of hair or a hair style similar to a length of hair or hair style of weft 28 or 114. During the assembly process shown in FIG. 18, weft 28 is wrapped along the spine and weft 114 is wrapped adjacent to weft 28. Weft 116 is then wrapped adjacent to weft 114 and is positioned adjacent to the next wrap of weft 28. This allows the hair strands from each of the wefts 28, 114 and 116 to be blended together or layered into the desired hair style.

Figure 21:
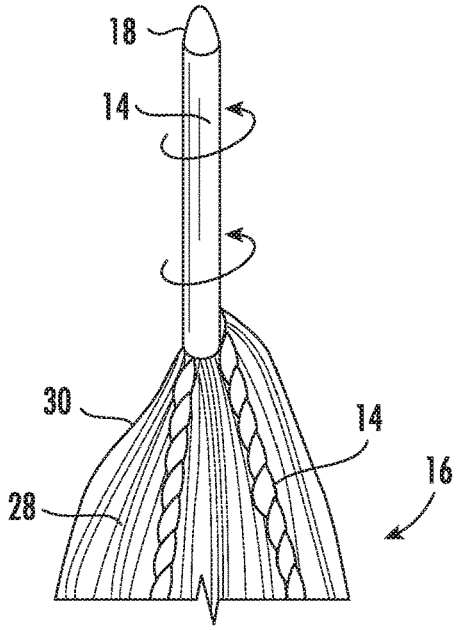
FIG. 21 is a perspective view of an alternate hair configuration assembled using the embodiment shown in FIG. 18.
Figure 22:
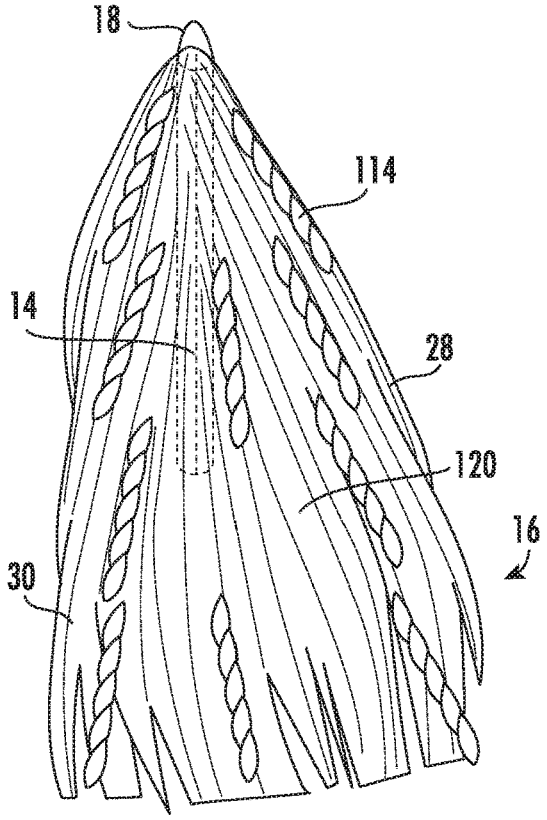
FIG. 22 is a perspective view showing the hair configuration of FIG. 21.

As shown in FIGS. 21 and 22, the hair strands 30 of each weft 28, 114 and 116 may be formed as multiple long hair strands with multiple braids, accessories or differing colors to provide a hair piece having multiple accents. The hair strands 30 of this embodiment may be used in a long and down arrangement or may be wrapped around a top knot for height, volume and texture in the desired hair style. As shown in this embodiment, wefts 28 and 116 may be formed of long hair strands while weft 114 may be formed with braids, colors, accents or accessories. This allows the final hair style to include the braids, accents, colors or accessories to be blended into the hair piece. As with the prior embodiments, one or more of the wefts 28, 114 and 116 may include wires or stiffening members incorporated therein or hair strands of differing lengths to allow the user to arrange this embodiment into a desired hair style.

Figure 23:
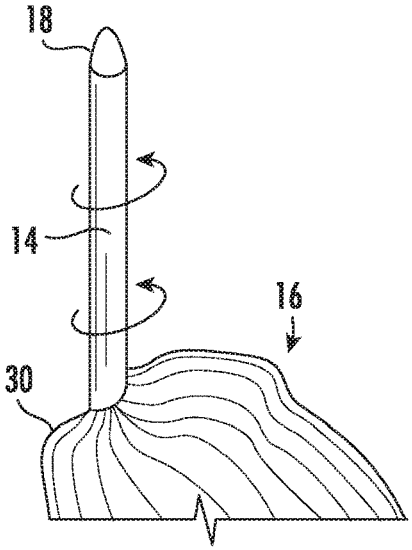
FIG. 23 is a perspective view of an alternate hair configuration assembled using the embodiment shown in FIG. 18.
Figure 24:
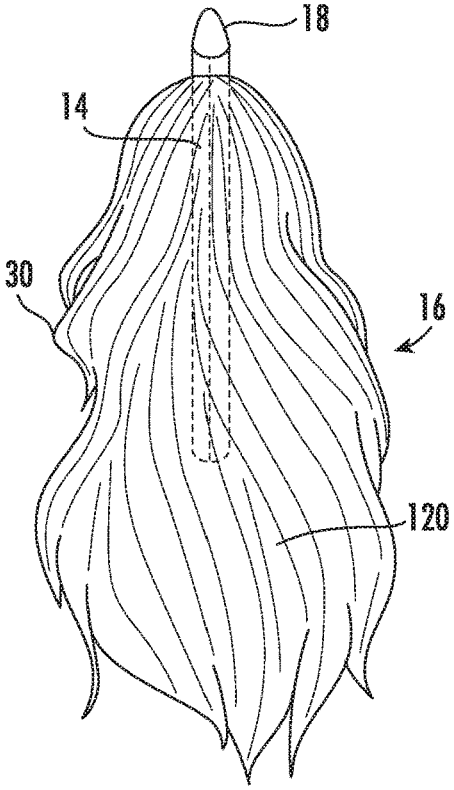
FIG. 24 is a perspective view showing the hair configuration of FIG. 23.

As shown in FIGS. 23 and 24, the hair strands 30 of each weft 28, 114 and 116 may be formed as multiple long wavy hair strands. The hair strands 30 of this embodiment may be used in a long and down arrangement, halfway up or down or may be wrapped around a top knot for height, volume and texture in the desired hair style. As shown in this embodiment, wefts 28, 114 and 116 may be formed of long wavy or "crimpy" hair strands. This allows the final hair style to include long wavy hair strands to be blended into the hair piece. As with the prior embodiments, one or more of the wefts 28, 114 and 116 may include wires or stiffening members incorporated therein or hair strands of differing lengths to allow the user to arrange this embodiment into a desired hair style. Similarly, each strand may also include a wire or similar flexible and bendable material to allow the user to adjust each strand into the desired configuration or hair style.

Figure 25:
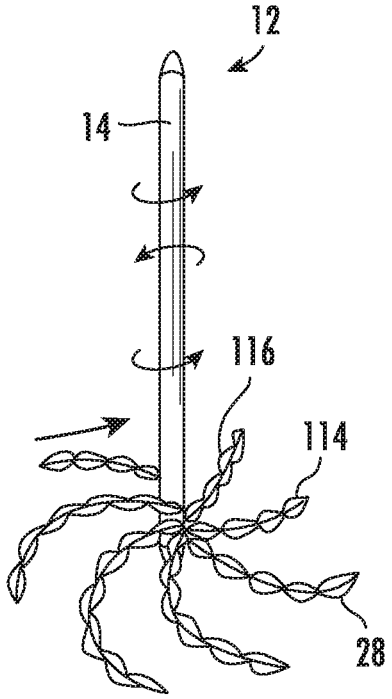
FIG. 25 is a perspective view of an alternate hair configuration assembled using the embodiment shown in FIG. 18.
Figure 26:
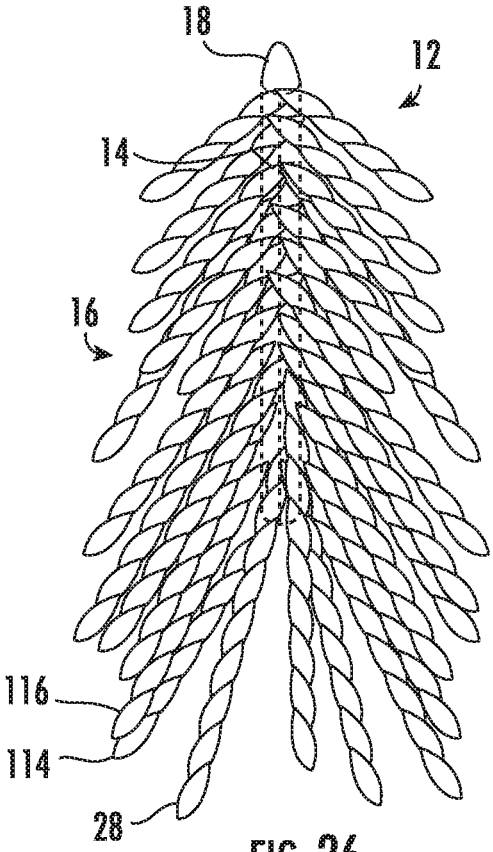
FIG. 26 is a perspective view showing the hair configuration of FIG. 25.

As shown in FIGS. 25 and 26, the hair strands 30 of each weft 28, 114 and 116 may be formed as multiple long hair strands with multiple small braids or twists. The hair strands 30 of this embodiment may be used in a long and down arrangement or may be wrapped around a top knot for height, volume and texture in the desired hair style or half-way up and down to provide volume on the top of the user's head. As shown in this embodiment, wefts 28, 114 and 116 may be formed of multiple small braids. This allows the final hair style to include the braids while adding accents, colors or accessories to be attached to the hair piece. As with the prior embodiments, one or more of the wefts 28, 114 and 116 may include wires or stiffening members incorporated therein or hair strands of differing lengths or stiffness to allow the user to arrange this embodiment into a desired hair style having multiple braids.

Figure 27:
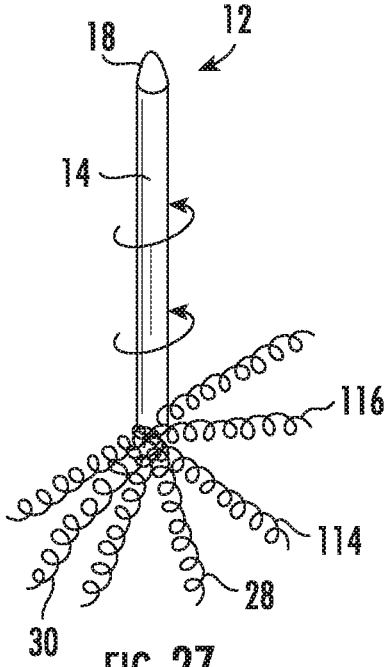
FIG. 27 is a perspective view of an alternate hair configuration assembled using the embodiment shown in FIG. 18.
Figure 28:
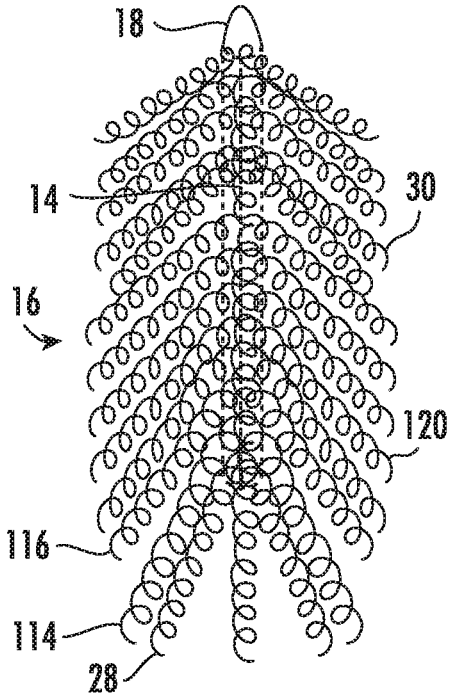
FIG. 28 is a perspective view showing the hair configuration of FIG. 27.

As shown in FIGS. 27 and 28, the hair strands 30 of each weft 28, 114 and 116 may be formed as multiple long hair strands with multiple small curls. The hair strands 30 of this embodiment may be used in a long and down arrangement or may be wrapped around a top knot for height, volume and texture in the desired hair style or half-way up and down to provide volume on the top of the user's head. This allows the final hair style to include the curls while adding accents, colors or accessories to be attached to the hair piece. As with the prior embodiments, one or more of the wefts 28, 114 and 116 may include one or more additional wires 120 or stiffening members incorporated therein or hair strands of differing lengths to allow the user to arrange this embodiment into a desired hair style having multiple braids.

Figure 29:
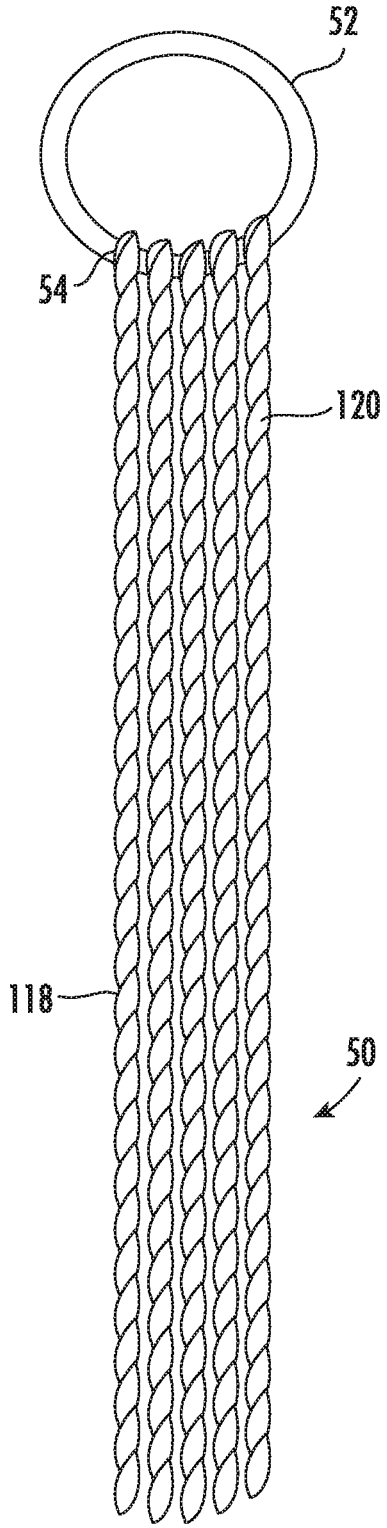
FIG. 29 is a perspective view of an alternate hair configuration similar to the embodiment shown in FIG. 11.
Figure 30:
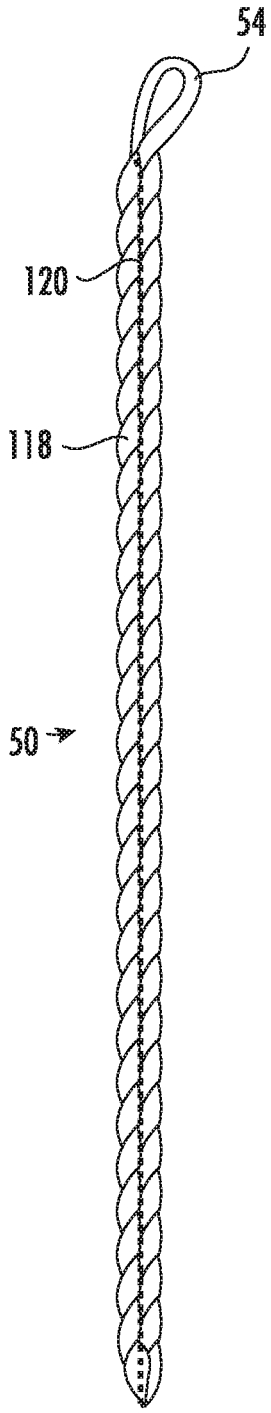
FIG. 30 is a perspective view of an alternate hair configuration similar to the embodiment shown in FIG. 7.

FIGS. 29-30 are illustrative of a further embodiment of the present invention wherein the ponytail 50 is configured as an elongate single or multi braid ponytail. As shown in this embodiment, a flexible loop 52, is provided for creating ponytails. The loop 52 is essentially a continuous strand, ring, or band of elastic, such as rubber, enclosed or covered by an elastic fabric formed into a continuous loop. The loop 52 can be any dimension although, approximately three inches in diameter in a normal non-extended state may be used in this example. Any part of it or its whole is expandable to several times its normal length while at the same time being foldable and twistable. One end of the ponytail 50 of this embodiment includes single or multiple strands of hair that are braided into a loop of hair 54 and the loop 52 is threaded through the loop of hair 54. In this embodiment, the opening of the loop 52 is preferably aligned parallel to the loop of hair 54 to allow the ponytail 50 to lay flat once it is placed on the head of the user. The hair strands are twisted and braided into multiple strands or a long single braid at the other end 56 of the ponytail 50. In an example of this embodiment, the hair may be approximately 62 inches to form an elongate single braid of approximately 31 inches although any length, style color or durometer may be used.

In the embodiment shown in FIGS. 29 and 30, the braid 118 may be a single braid as shown in FIG. 30 or multiple braids or twists as shown in FIG. 29. The braids of this embodiment may include one or more stiffening members such as wires 120 or plastic members to allow the braid 118 to be bent or arranged into the desired hair style. The embodiment of FIG. 29 is illustrative of the sue of multiple braids 118 that are arranged on a flexible loop 52. The loop 52 is similar to the embodiments described above. The loop 54 of the braids 118 are preferably formed of the hair of the braid that is looped onto itself when the hair piece is formed. The embodiment shown in FIG. 30, is illustrated as a single elongate braid 118. In this embodiment, the connection of the braid to the head of the user is accomplished by inserting the user's hair through the loop 52 of the braid. In each of these embodiments, the one or more wires 120 extend lengthwise along the braid to allow for the braid 118 to be flexed and oriented into the desired configuration. Additionally, the multiple braids 118 of FIG. 29, may include wires 120 or flexible materials of differing colors, textiles, durometer or stiffness to facilitate further hair styles.

Finally, it is contemplated that the individual components described above may be supplied to the end user as a "kit" with instructions for the user to create the desired hair arrangement or hair piece. For example, the hair pieces may be of the type shown in FIG. 1 or FIGS. 18-28 wherein the kit includes each of the elements described above and which are adjusted or assembled by the user. Another kit may be formed of elements from the embodiments described above with respect to FIGS. 6-17 wherein the elements may be individually packaged and adjusted or assembled by the user. Another kit may be formed of a combination of the elements of the embodiments described above. Each of these kits may include instructions similar to the following to illustrate the ease and simplicity of using the embodiments described above. For example, the instructions may instruct the user to transform any look with your favorite "hair" kit to create multiple looks. This may be accomplished by attaching the hair piece or ponytail to any type of foundation. Insert the tip and push through any base. To secure the wrap, bend and hide the tip. To adjust the length. For a shorter look, pull it through more; For longer, pull it through less. Mold, wrap, twist, bend and create. For banded kits, attach to any type of foundation. Take the band and attach to any type of foundation. Tighten and secure as you would with a hair elastic.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected. Similarly, as discussed above, the term "hair" is intended to be given its broadest reasonable interpretation as referenced herein and as set forth in the attached claims. Additionally, the preferred dimensions set forth above are intended to be for illustrative purposes unless set forth in the attached claims.

The invention claimed is:

1. A removable hair piece for attachment to the hair of a user consisting of:

a weft of hair having first and second ends and including a plurality of hair strands having a first end and a second end and a lengthwise dimension extending therebetween;

an elongate and flexible spine member wherein the spine member is an elongate and hollow cylindrical member that has a flexible wire member with sufficient tensile strength such that the spine member is bendable into a desired configuration and includes distal and proximal ends and lengthwise dimension therebetween and wherein the weft of hair is wrapped along the lengthwise dimension of the spine member between the distal and proximal ends of the spine member and from a location near one of the distal and proximal ends of the spine member to a location near the other of the distal and proximal ends of the spine member such that the first end of the hair strands are adjacent to the spine member and the second end of the hair strands of the weft of hair extend therefrom; and a tapered tip member located on the distal end of the spine member wherein the tip member is configured to pass through the hair of the user in combination with at least a portion of the spine member to retain the bendable spine member in the hair of the user.

2. The removable hair piece of claim 1, further including the spine member having the lengthwise dimension between the distal and proximal ends of the spine member that is at least one half of the lengthwise dimension of the hair strands between the first and second ends of the hair strands.

3. The removable hair piece of claim 1, further including the spine member having the lengthwise dimension between the distal and proximal ends of the spine member is less than the lengthwise dimension of the hair strands between the first and second ends of the hair strands.

4. The removable hair piece of claim 1, wherein the spine member includes the weft of hair wrapped around and adjacent to the distal end of the spine member and the first end of the hair strands are wrapped around the spine member and the second ends of the hair strands extend from the spine member.

5. The removable hair piece of claim 1, wherein an attachment member includes the spine member and tip member, and the attachment member engages the first end of the weft of hair to attach the weft of hair to the spine member and the weft of hair is wrapped around substantially the entire lengthwise dimension of the spine member and, wherein at least a portion of the spine member is bendable and attachable to the hair on the head of the user to retain the hair piece in a ponytail configuration on the user's head.

6. The removable hair piece of claim 1, wherein the hair strands include a first material of a first durometer and a second material of a different second durometer.

7. The removable hair piece of claim 1, wherein the hair strands include multiple strands of differing materials.

8. The removable hair piece of claim 1, wherein the spine member includes the flexible wire member having a first rigidity and the cylindrical member having a different second rigidity.

9. A removable hair piece for attachment to the hair of a user consisting of:

a ponytail having a weft of hair having first and second ends and including a plurality of hair strands having a first end and a second end and a lengthwise dimension extending therebetween;

an attachment member sized and configured to bind the first end of the weft of hair wherein the attachment member includes a spine member and a tapered tip member;

the spine member is an elongate and hollow cylindrical member with a flexible wire member wherein the spine member includes distal and proximal ends and a lengthwise dimension therebetween and wherein the weft of hair is wrapped along the lengthwise dimension of the spine member between the distal and proximal ends thereof of the spine member and from a location near one of the distal and proximal ends of the spine member to a location near the other of the distal and proximal ends of the spine member such that the second end of the hair strands extend therefrom;

the tapered tip member located on the distal end of the spine member wherein the tip member is configured to pass through the hair of the user in combination with at least a portion of the spine member to retain the ponytail in the hair of the user; and wherein the flexible wire of the spine member includes a first material that is bendable, and the tapered tip is formed of a second material.

10. The removable hair piece of claim 9, wherein the spine member includes a second tapered tip member on the proximal end thereof.

11. A removable hair piece for attachment to the hair of a user consisting of:

a ponytail having a weft of hair strands having a first end and a second end and a lengthwise dimension extending therebetween;

an attachment member attached to the first end of the weft of hair wherein the attachment member includes a spine member and a tapered tip member;

the spine member including an elongate and cylindrical tube with a flexible wire therein and wherein the spine member includes distal and proximal ends and a lengthwise dimension therebetween and the weft of hair is wrapped along the lengthwise dimension of the spine member between the distal and proximal ends of the spine member and from a location near one of the distal and proximal ends of the spine member to a location near the other of the distal and proximal ends of the spine member such that the second end of the hair strands extend therefrom;

the tapered tip member extending from the distal end of the spine member wherein the tip member is formed of a material that is different than a material that the spine member is formed of, and the tapered tip member is configured to pass through the hair of the user in combination with at least a portion of the spine member; and wherein at least a portion of the spine member has sufficient tensile strength such that the spine member is bendable into a desired configuration and attachable to the hair on the head of the user to retain the ponytail in position on the user's head.

* * * * *